US012516491B2

(12) United States Patent
Dunn et al.

(10) Patent No.: US 12,516,491 B2
(45) Date of Patent: Jan. 6, 2026

(54) SCOUR PROTECTION SYSTEMS, METHODS, AND APPARATUS

(71) Applicant: Energy Future, Inc., New York, NY (US)

(72) Inventors: Cameron Dunn, Texas, TX (US); Steven Downie, London (GB); Tianmin Zhou, Texas, TX (US)

(73) Assignee: Energy Future, Inc.

( * ) Notice: Subject to any disclaimer, the term of this patent is extended or adjusted under 35 U.S.C. 154(b) by 236 days.

(21) Appl. No.: 18/517,133

(22) Filed: Nov. 22, 2023

(65) Prior Publication Data

US 2024/0175231 A1 May 30, 2024

Related U.S. Application Data

(60) Provisional application No. 63/427,861, filed on Nov. 24, 2022.

(51) Int. Cl.

| | |
|---|---|
| ***E02D 31/08*** | (2006.01) |
| ***E02D 5/22*** | (2006.01) |
| ***E02D 27/52*** | (2006.01) |

(52) U.S. Cl.

CPC ..... *E02D 31/08* (2013.01); *E02D 5/223* (2013.01); *E02D 27/525* (2013.01)

(58) Field of Classification Search

CPC ..... E02D 31/08; E02D 5/223; E02D 27/525; E02D 27/10; E02D 27/12

(Continued)

(56) References Cited

U.S. PATENT DOCUMENTS

| | | | |
|---|---|---|---|
| 4,683,156 | A | 7/1987 | Waters |
| 4,722,639 | A | 2/1988 | Alsop |

(Continued)

FOREIGN PATENT DOCUMENTS

| | | | |
|---|---|---|---|
| CN | 102388188 | A | 3/2012 |
| CN | 112647530 | A | 4/2021 |

(Continued)

OTHER PUBLICATIONS

International Search Report, dated Mar. 20, 2024, for PCT/US23/81031, International Filing Date Nov. 24, 2023, consisting of 23 pages.

(Continued)

*Primary Examiner* — Paola Agudelo
(74) *Attorney, Agent, or Firm* — Gearhart Law LLC

(57) ABSTRACT

Systems, methods, and apparatus are disclosed involving scour protection of undersea monument foundations, such as monopile foundations. A preferred embodiment comprises an Advanced Ecological Scour Protection System (AESPS) that enhances offshore scour protection through an innovative combination of eco-friendly engineering units and natural materials. In a preferred embodiment, an AESPS includes two main features comprising a single-layer rock blanket deployed first at an intended site of the foundation, followed by installation of fronded eco-concrete mattress units to form a peripheral ring border around the rock blanket. The foundation then may be installed directly into and through the rock blanket, with a monument installed on the foundation, and an export cable extending from the monument, over the mattress units, and through the fronds. Such an AESPS may eliminate critical risks of secondary scour damage, cable lateral movement, and marine life deterioration.

12 Claims, 5 Drawing Sheets

(58) Field of Classification Search
USPC ..... 52/167.1
See application file for complete search history.

(56) References Cited

U.S. PATENT DOCUMENTS

| | | | | |
|---|---|---|---|---|
| 5,193,937 | A * | 3/1993 | Miller | E02B 3/127 405/172 |
| 5,224,794 | A | 7/1993 | Atkinson | |
| 5,876,151 | A | 3/1999 | Brown, III et al. | |
| 6,027,285 | A * | 2/2000 | Angel | E02B 3/123 405/172 |
| 9,458,589 | B2 | 10/2016 | Gallagher | |
| 9,869,069 | B2 | 1/2018 | Durrant | |
| 11,162,237 | B2 * | 11/2021 | Benton, Jr. | E02B 17/0017 |
| 2011/0305510 | A1 | 12/2011 | Durrant | |
| 2014/0119836 | A1 * | 5/2014 | Thompson | E02D 17/202 405/195.1 |
| 2016/0002872 | A1 | 1/2016 | Gallagher et al. | |
| 2017/0081819 | A1 * | 3/2017 | Nadeau | E02B 3/12 |
| 2019/0177942 | A1 | 6/2019 | Serna García-Conde et al. | |

FOREIGN PATENT DOCUMENTS

| | | | |
|---|---|---|---|
| CN | 214574099 | U | 11/2021 |
| DE | 202017005092 | U1 | 1/2018 |
| DE | 102020128293 | A1 | 4/2022 |
| WO | 2003080939 | A1 | 10/2003 |
| WO | 2010097199 | A1 | 9/2010 |
| WO | 2014131660 | A1 | 9/2014 |

OTHER PUBLICATIONS

Whitehouse, Richard, Evaluating scour at marine gravity foundations, Maritime Engineering, Dec. 2011, vol. 164, Issue MA4, ICE Publishing, captured from <https://doi.org/10.1680/maen.2011.164.4.143>.

Ruiz De Termino Alonso, Ismael, Gravity base foundations for offshore wind farms: marine operations and installation processes, Aug. 2013, captured from <http://hdl.handle.net/10902/3429>.

Petersen, Thor Ugelvig, Edge scour at scour protections around piles in the marine environment—Laboratory and Field Investigation, Elsevier, Dec. 2015, vol. 106, pp. 42-72, captured from <https://doi.org/10.1016/j.coastaleng.2015.08.007>.

Gao, Fu Ping, On the instability of offshore foundations: theory and mechanism, Science China, Physics, Mechanics & Astronomy, Dec. 2015, vol. 58, pp. 124701, captured from <http://dx.doi.org/10.1007/s11433-015-5745-9>.

Trygsland, Eirik, Numerical Study of Seabed Boundary Layer Flow around Monopile and Gravity-based Wind Turbine Foundations, NTNU, Jun. 2015, <http://hdl.handle.net/11250/2350752>.

Golightly, Chris, Offshore Wind Foundation Engineering: Fixed and Floating Structures, Conference: Presentation at HR Wallingford UK, Jun. 5, 2018, <https://www.researchgate.net/publication/325607324_Offshore_Wind_Foundation_Engineering_Fixed_and_Floating_Structures_-_5th_June_2018>.

Tavouktsoglou, Nikolas Sokratis, Scour and Scour protection around offshore gravity based foundations, Doctoral thesis (Eng D), UCL (University College London), 2018 captured from <https://discovery.ucl.ac.uk/id/eprint/10044922>.

Arboleda Chavez, Carlos Emilio, et al., Large-Scale Experiments to Improve Monopile Scour Protection Design Adapted to Climate Change—The PROTEUS Project, Energies, vol. 12, 1709, May 6, 2019 <https://doi.org/10.3390/en12091709>.

Tang, Zi-Hao, et al., Countermeasures for Local Scour at Offshore Wind Turbine Monopile Foundations: A Review, Water Science and Engineering, Oct. 23, 2021, vol. 15, Iss 1, pp. 15-28, captured from <https://doi.org/10.1016/j.wse.2021.12.010>.

* cited by examiner

SCOUR PROTECTION SYSTEMS, METHODS, AND APPARATUS

CLAIM OF PRIORITY

This application is a Non-provisional Application claims priority from U.S. provisional Application No. 63/427,861 filed Nov. 24, 2022 the contents of which is hereby fully incorporated by reference.

BACKGROUND OF THE INVENTION

Field of the Invention

The invention relates to systems, methods, and apparatus involving scour protection of undersea monument foundations, such as monopile foundations.

Description of Related Art

The related art includes, for instance, methods, products, and systems, relating generally to offshore scour protections that use artificial fronds, eco-friendly concrete materials, and engineering topology, which may promote marine habitat and protection from scour for underwater foundations.

Most of the near shore seabed is made up of sediment of varying sizes, allowing continuous movement of particles caused by waves and currents. This movement changes around the foundations of fixed bottom offshore wind structures, washing the sand and smaller particles away from one side until a hollow scour pit is formed. For a structure like a monopile foundation used for an offshore wind-powered generator monument, which has a large, concentrated load (wind turbine) at the top, fatigue life is often sensitive to changes in natural frequency that may result from removal of seabed support at the mudline. Therefore, scour is a major environmental hazard for offshore foundations, and undersea scour needs to be properly dealt with to minimize scour's negative effect on the foundation performance.

Traditional two-layer scour countermeasures exist, such as riprap rocks, that serve as physical barriers withstanding the shear stresses imparted by flowing water. Their primary functional requirements are simply to maintain the bed level of an undersea ground surface on which a foundation is installed. Secondary requirements are imposed by the design of the cable and cable protection system, which may require the cable to remain restrained at specific points in order to ensure acceptable fatigue performance. Typically, a filter layer sits at the bottom, is made of small particles, and will be put in place before the deployment of the structural foundation. An armor layer may consist of larger sized strata that then may be installed on the top of the filter layer, and on top of the power export cable.

Despite their incremental improvements in the seabed stability, traditional approaches experience major risks in highly mobile environments, such as the following risks: (a) movement, reduction, erosion, or failure of armor units due to environmental action, with typical failure criteria being exposure of the filter layer or at least 50% reduction in overall thickness; (b) sinking of the armor layer due to washout of particles from underlying filter layers and seabed; and (c) exposure of the cable that places the cable at risk of anchor strikes or fatigue from environmental action.

In addition, traditional scour protection methods may lead to detrimental environmental impacts by changing the seabed conditions and using materials not beneficial to marine life and as such are the subject to environmental review and expectations that these negative influences can be mitigated. For instance, some prior art methods use pure gravity-based countermeasures to resist scour formation, with no consideration of flow diversion, while others doesn't consider ecological impacts or seek to promote ecological benefits of the system. Other prior art methods may use a solid-water-break-wall-type structure to divert waterflows as a means to affect and hopefully control the scour development, but a solid-wall-based diversion of waterflow may have detrimental impacts on surrounding marine life. The prior art techniques tend to avoid a systematic consideration of a scour system's reliability and efficiency as such relate to ecological considerations, concerns, and impacts thereof.

There is a continuing need for improvements to the state-of-the-art scour protections adapted for offshore wind foundations that can be easily, cheaply, and reliably installed and maintained under harsh undersea environments. Similar to other environmental protection movements, the undersea monument industry has acknowledged that the next generations of the scour protection design should lead to benefits for each stakeholder in the marine space, such as with implementing a dual-benefit concept that considers not only engineering performance, but also a scour protection system's positive influence on biological productivity and ecological sustainability.

In contrast to the prior art, the present invention is unique in its design, in its functionality, and in its intended use of the present invention. The present invention is unlike prior art concepts that have approached scour protection from other angles. The prior art lacks the ease and flexibility of the present invention to accommodate one or multiple scour protection techniques while not impeding the natural habitat of the protected landscape. In contrast, the present solution seeks to enable one or multiple scour protection techniques that are easy to apply, flexible in number and location, and do not impede the natural habitat of the protected landscape.

As described below, embodiments of the present invention include the use of novel features of scour protection, using systems and methods different from those of the prior art systems and methods.

BRIEF SUMMARY OF THE INVENTION

The invention relates to systems, methods, and apparatus involving scour protection of undersea foundations, and an exemplary embodiment of the invention may be referred to as an Advanced Ecological Scour Protection System (AESPS). In contrast to the prior art, an AESPS avoids a single-purpose gravity-based method, and instead employs a multi-purpose eco-friendly solution that adopts both flow-diversion and gravity-based methodologies.

A preferred embodiment of an Advanced Ecological Scour Protection System (AESPS) may comprise two main features to enhance the foundation stability and the nearby eco-productivity. The first feature may include a single application layer rock blanket, applied on an undersea ground surface, over and around an intended foundation site. The second feature may include a fronded concrete mattress border, formed as a peripheral ring on, over, and around an edge of the rock blanket at a border of the rock blanket and the undersea ground surface.

In a center area of the foundation location, instead of the two-layer or three-layer traditional system of a filter layer, a riprap rock layer, and an armor layer, the present invention includes a single-layer system that would be deployed to cover the target site, with the single layer made of either natural materials or engineering-tailored components based on availability or cost of materials at the site or the geological conditions. The single layer may comprise a so-called "dynamic single layer rock blanket" system that could provide various advantages, such as: (a) better position control and easier installation process, in which and because the blanket may be installed prior to installation of the foundation; (b) better cost efficiency and supply chain resilience as the individual components of the system and their installation are understood by industry; (c) less offshore survey and inspection efforts during construction without multi-layer tolerance control; and (d) faster and more affordable single vessel mobilization with less material to be delivered.

Besides these benefits of a single layer solution, there still exist potential downsides to having only the single layer solution. According to the recent attempts taking place in North Sea, with no top armor layer present on top a single layer installation, significate secondary scour development could occur near the edge of the cable sheath and further expand to the center. Attempts also have shown that if the export cable is installed after the scour protection system and is placed freely on top of the rock blankets, the cable therefore lacks lateral support to hold the position. In an extreme case, such as an occurrence of a 10-year storm, the cable may deviate from the original position due to wave, current, and tidal actions, causing issues for protective berms, cable crossing structure, and the cable itself.

Exemplary embodiments of an AESPS utilizes a fronded eco-friendly concrete mattress installation as a second subsystem as a differentiator to address observed deficiencies and provide additional benefits. Along the circumference of the central dynamic rock blanket area, a ring shape arrangement of the "fronded eco-concrete mattress" overlaps and sits on the in-place single layer blanket to reinforce the system's edge stability and to laterally support the export cables lying across the fronded concrete mattress units. These fronds, or fronded elements, replicate the natural behavior of seaweed, have unique benefits for diverting current flow, and provide sheltered spaces in which to shelter the cable, while promoting sediment build up to further secure the area in the long run as a reversing process of the natural scour mechanisms. A preferred fronded eco-mattress has a surface-tailored gravity base, which is made of eco-friendly concrete or other equivalent materials and serves as a bio-friendly artificial substrate that attracts and supports marine life by minimizing the chemical pollution and maximizing the habitat space. Preferably highly buoyant, exemplary fronds may comprise polypropylene or similar materials that exhibit high buoyancy and durability, and the fronds preferably are permanently connected to a concrete base mattress, which once installed, forms a densely protected low flow zone around the foundation.

The design philosophy of the AESPS considers the reliability, the durability, and the cost efficiency of the system. The central foundation area is protected by a dynamic single-layer rock blanket, which may include several feet of basic rocks that are widely used and well understood by the industry from the conventional practices. The existing robust supply chain and the installation fleet can further smooth the Engineering-Procurement-Construction-Installation (EPCI) process and accelerate the project schedule. The fronded eco-concrete mattress is utilized only to create a durable border along an outer edge to prevent the primary scour initial damage while also, providing lateral support for the export cable. These advanced features reduce a system's risk of this potential failure mechanism and enable the decrease of the overall size of the scour protection with the current flow diverted by their frond lines. In addition, the eco-friendly concrete materials, the engineering tailored surface topologies, as well as the artificial fronds, are all designed to attract and support marine habitat and therefore marine life, benefitting local stakeholders with the spotlighted dual concept of AESPS.

In accordance with a first aspect of the invention, an apparatus is disclosed that is adapted for use in protecting an undersea monument foundation against undersea scour, in which the apparatus comprises: a single-application layer rock blanket and a fronded concrete mattress border covering and surrounding a periphery of the rock blanket.

In accordance with a second aspect of the invention, a system is disclosed that is adapted for use in protecting an undersea monument foundation against undersea scour, in which the system comprises: an application of a single-application layer rock blanket applied to an undersea ground surface at an intended site of an undersea monument foundation, and an installation of a fronded concrete mattress border covering and surrounding a periphery of the rock blanket, wherein the installation of the fronded concrete mattress border is adapted to be installed below and support any export cable exiting a monument positioned on a foundation installed at the intended site, and wherein a plurality of fronds of the fronded concrete mattress is adapted to engage and shelter the export cable supported on the installation.

In accordance with a third aspect of the invention, a method is disclosed that is adapted for use in protecting an undersea monument foundation against undersea scour, in which the method comprises: preparing an undersea ground surface at an intended site of an undersea monument foundation; applying a single-application layer rock blanket to the undersea ground surface at the intended site of the undersea monument foundation; and installing a fronded concrete mattress border covering and surrounding a periphery of the rock blanket, wherein installing the fronded concrete mattress border is adapted to position the fronded concrete mattress border below and to support any export cable exiting a monument positioned on a foundation installed at the intended site, and wherein a plurality of fronds of the fronded concrete mattress is adapted to engage and shelter the export cable supported on the installation.

Further aspects of the invention are set forth herein. The details of exemplary embodiments of the invention are set forth in the accompanying drawings and the description below. Other features, objects, and advantages of the invention will be apparent from the description and drawings, and from the claims.

BRIEF DESCRIPTION OF THE DRAWINGS

By reference to the appended drawings, which illustrate exemplary embodiments of this invention, the detailed description provided below explains in detail various features, advantages, and aspects of this invention. As such, features of this invention can be more clearly understood from the following detailed description considered in conjunction with the following drawings, in which the same reference numerals denote the same, similar, or comparable elements throughout. The exemplary embodiments illustrated in the drawings are not necessarily to scale or to shape and are not to be considered limiting of its scope, for the invention may admit to other equally effective embodiments having differing combinations of features, as set forth in the accompanying claims.

DETAILED DESCRIPTION OF THE INVENTION

Figure 1:
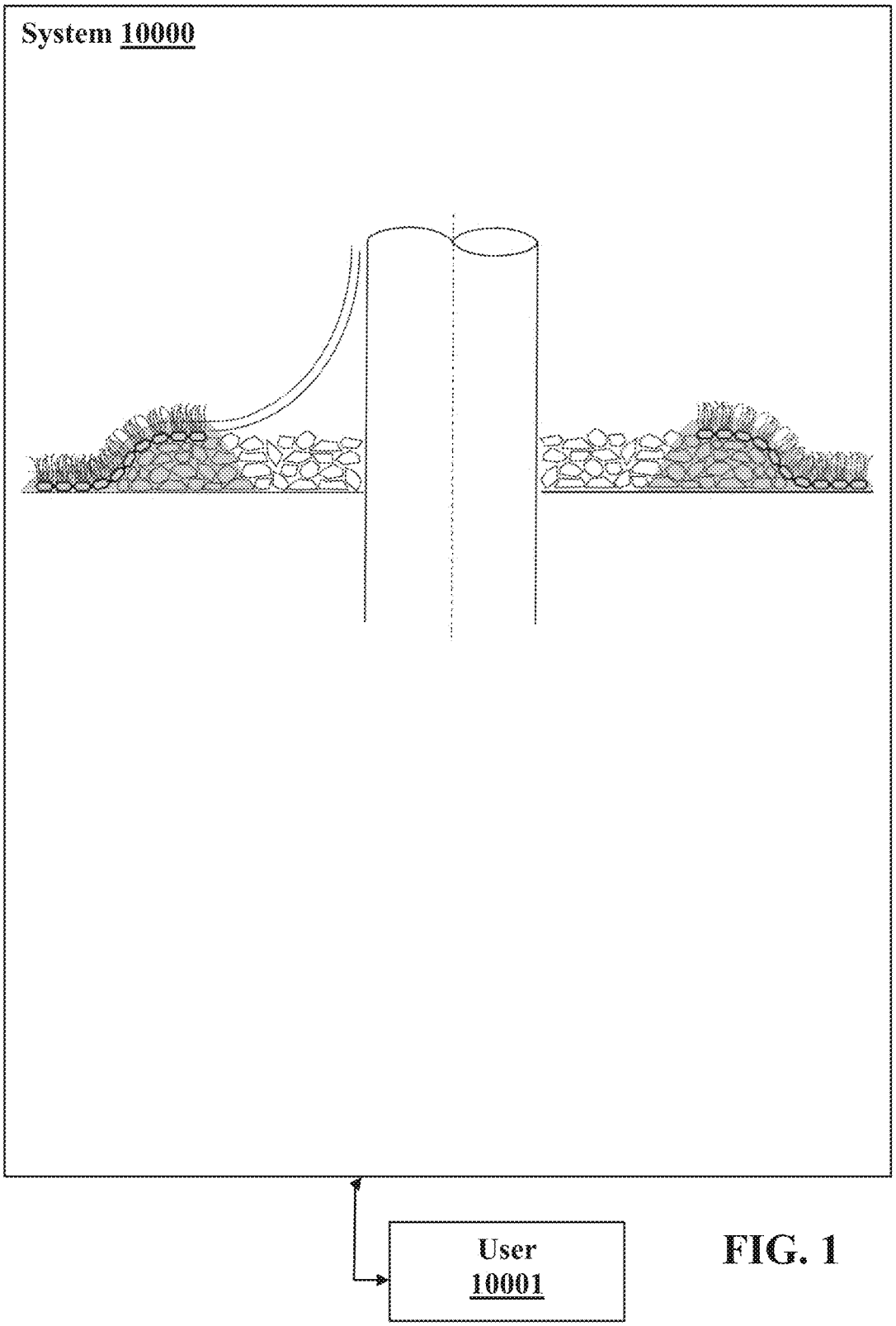
FIG. 1 shows a side elevation cross-sectional view of a simplified depiction of an exemplary embodiment of a system, according to aspects of the invention, such as an offshore monopile foundation protected by an AESPS.

The invention relates to systems, methods, and apparatus involving scour protection of undersea foundations, and an exemplary embodiment of the invention may be referred to as an Advanced Ecological Scour Protection System (AESPS).

The preferred embodiments of the present invention will now be described with reference to the drawings. Identical elements in the various figures are identified with the same reference numerals. Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Also, the exemplary embodiments presented below maybe combined in any combination of ways, i.e., any element from one exemplary embodiment may be used in any other exemplary embodiment, without departing from the scope of the disclosure.

Exemplary Embodiments of a System

A preferred exemplary embodiment of an Advanced Ecological Scour Protection System (AESPS) may comprise two main features to enhance the foundation stability and the nearby eco-productivity. The first feature may include a single application layer rock blanket, applied on an undersea ground surface, over and around an intended foundation site. The second feature may include a fronded concrete mattress border, formed as a peripheral ring on, over, and around an edge of the rock blanket at a border of the rock blanket and the undersea ground surface.

The single-layer rock blanket is an example of a gravity-based protection of a central area, and in the preferred embodiments, the central area uses rocks in a single layer applied in a single application to form the gravity-based rock blanket. However, in other embodiments, the central area gravity-based protection need not necessarily to be a rock blanket or have a blanket shape; rather, it can be loose rock materials, blankets, rigid covers, or any other preferred structural types decided by a project team. In such other embodiments, the choice of gravity-based protection of the central area preferably still allows the central area protection to be applied before the foundation is installed through the central area protection. In such other embodiments, a gravity-based cover may be selected that enhances the dynamic stability of the seabed, wherein any gravity-based cover that improves the (a) relative density of sediment; (b) bed roughness; (c) sediment diameter; and/or (d) sediment friction angle, will enhance the dynamic stability of the seabed. Therefore, alternative options such as riprap rock, rock bag, engineering cover, or artificial recycled materials can all serve the purpose. The decision regarding the choice of gravity-based protection preferably will be based on considerations of (a) material cost; (b) material accessibility within the region; and (c) constructability and installation complexity. Regarding complexity, it is worth noting that loose materials typically are less complex and can be deployed easily by barges, whereas engineering-tailored materials or structures typically are more complex and potentially could require advanced offshore installation equipment, such as a heavy-duty crane, ROV, subsea ultrasonic sensor, etc., that may limit, restrict, or prevent application of a more-complex solution within large water-depth zone.

As used herein, a "single-application layer" and a "single layer" are related terms that refer to a layer of material (e.g., rocks) applied to form a single layer, preferably applied uninterrupted in a single application process, in which the single layer may comprise a layer of rocks that may be several rocks deep, and may comprise rocks of various materials, shapes, and sizes applied to form the single layer. In some embodiments, a single layer could include applying a first layer of rocks of a first rock type, followed by applying a second layer of a second rock type, such as wherein the rocks of the second rock type may fill in gaps existing between rocks of the first rock type in the first layer.

Embodiments of the present invention offer various advantages over prior art systems. Application of a single-application layer rock blanket or other equivalent gravity-based materials lowers the requirement for transportation, installation, and construction monitoring. There is no specific requirement for the exact units/materials to be used for central area. The fronded mattress is introduced along the edge of the single layer zone, which significantly reduces various risks, such as have been observed in the North Sea, such as edge scouring, broken or missing cables, and material loss. The fronded mattress provides a suitable cable lateral support system, while not requiring any additional underwater support, remotely-operated vehicle (ROV), cable cover, or specific placement of the cable, thereby avoiding any long-term premature failure, and minimizing installation time and expense. Depending on the selection of central materials, the connection between the central zone units, of the single layer, and the circumference units, of the fronded eco-mattress, could vary between overlapping and soft linking or pre-assembling. The usage of an eco-friendly concrete materials and shapes for the fronded mattress encourages the development of underwater communities.

Drawings of Exemplary Embodiments of the Invention

Referring to the Figures, the Figures depict an exemplary undersea ground surface setting according to the present invention, in which a depicted scour protection system may employ an exemplary method to protect a monopile foundation against undersea scour. The depicted system may employ the depicted method to prepare an undersea ground surface at and around an intended site of a monopile foundation, such as clearing and/or cleaning the surface to receive a foundation; to use a single-application layer rock blanket to cover and reinforce the surface; and to install a fronded concrete mattress border on, at, and around a periphery of the rock blanket, before installing the monopile foundation and an export cable, such as from a wind-powered generator erected on the monopile foundation.

The preferred embodiments of the present invention will now be described with reference to the drawings. Identical elements in the various figures are identified with the same reference numerals. Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
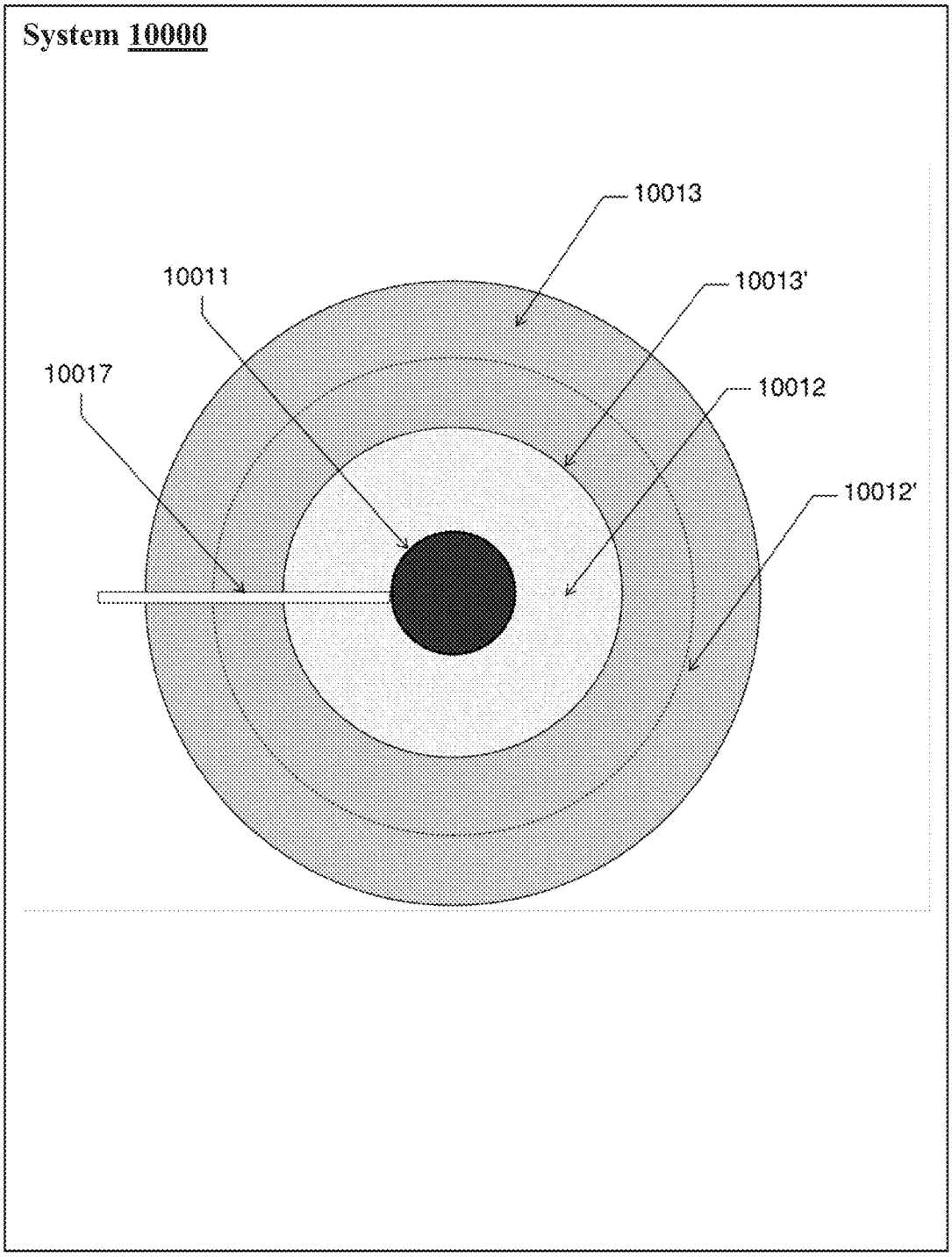
FIG. 2 shows a plan view of the simplified depiction of the exemplary embodiment of the system in FIG. 1, according to aspects of the invention.

Referring to FIG. 1, FIG. 1 shows a side elevation cross-sectional view of a simplified depiction of an exemplary embodiment of a system 10000, according to aspects of the invention, such as an offshore monopile foundation protected by an AESPS, with the general arrangement of AESPS around a monopile foundation. A user 10001 may design, install, operate, and/or maintain the system 10000. As depicted in FIG. 1 and FIG. 2, the system includes a monopile 10011 at a center, surrounded by an application of a single layer rock blanket 10012, and encircled by an installation of fronded concrete mattress units 10013. Exiting and extending from the monopile 10011 is an export cable 10017 that rests on an upper surface of the fronded concrete mattress installation 10013. The lateral extension of the AESPS scour protection is a function of a diameter of the monopile 10011, the designed scour depth, and the friction angle of the seabed soil. The ratio between the width of single layer rock blanket 10012 and the width of fronded eco-mattress installation 10013 may allow some level of flexibility according to specific site conditions and project requirements, given that the former is a compromise of budget control. The external cable 10017, as depicted, lays across the fronded zone of the fronded mattress installation 10013, getting supported laterally and vertically with the growing sediment 10018 in the area.

Referring to FIG. 2, FIG. 2 shows a plan view of the simplified depiction of the exemplary embodiment of the system in FIG. 1, according to aspects of the invention. With the use of the fronded mattresses installation 10013, which extends from the fronded mattress inner boundary 10013' and overlaps the outer rock blanket boundary 10012', the system 10000 provides improved diversion of the current flow, such that the scour system 10000 may cover a smaller area than that of conventional scour systems currently used today. This decreased footprint will decrease the overall impact of the foundation systems for the offshore wind development. The smaller size will offset the anticipated higher cost of each fronded mattress 10007, having the overall scour system 10000 be cost-competitive with a typical scour system used today.

Figure 3:
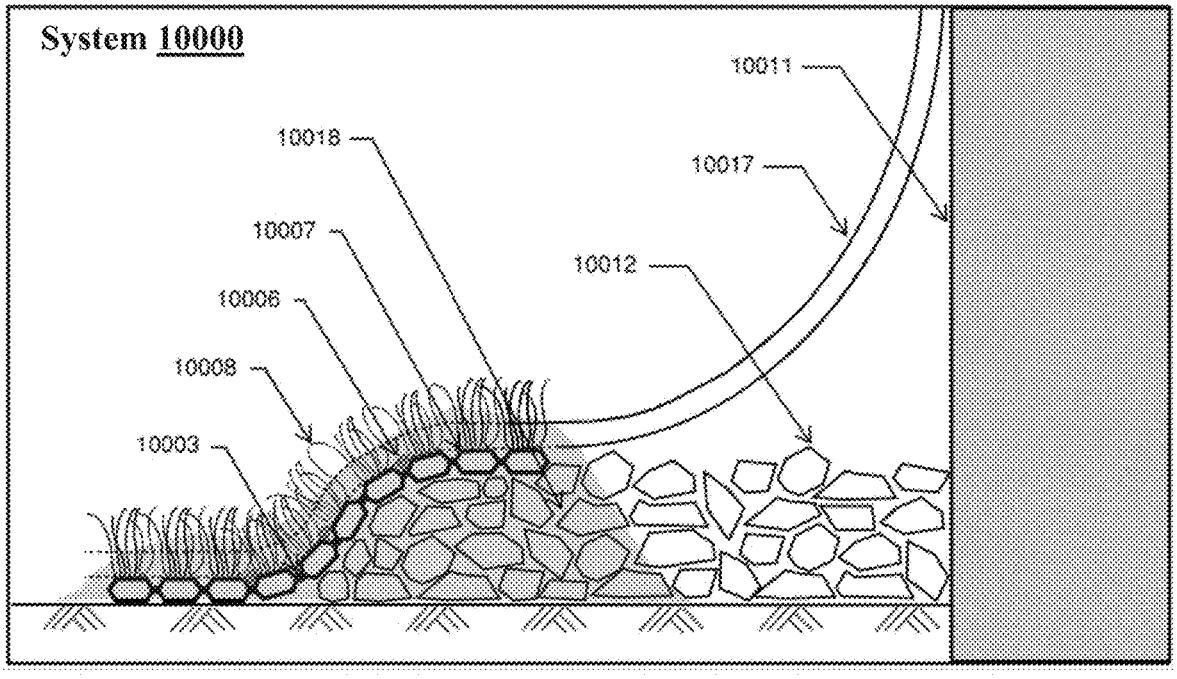
FIG. 3 shows a side elevation cross-sectional view of the simplified depiction of the exemplary embodiment of the system in FIG. 1, with an exemplary in-place fronded eco-concrete mattress and an export cable buried by a subsequently-formed sediment protection layer, according to aspects of the invention.

Referring to FIG. 3, FIG. 3 shows a side elevation cross-sectional view of the simplified depiction of the exemplary embodiment of the system 10000 in FIG. 1, with an exemplary in-place fronded eco-concrete mattress 10007 and an export cable 10017 buried by a subsequently-formed sediment protection layer 10018, according to aspects of the invention. The fronded mattress installation 10013 may include multiple fronded eco-concrete mattress units 10007 interconnected by connections 10010 to reduce movement and shifting of the units 10007 with respect to each other and to the monopile 10011. Fronds 10008 are depicted as floating upward from the fronded mattress units 10007, with the accumulated sediment layer 10018 having accumulated among and between the fronds 10008, and over the cable 10017 lying among and between the fronds 10008. Over time, after installation of the system 10000, sea life 10006 may attach to and accumulate on the fronded mattress units 10007, further promoting the natural environment and enhancing the biodiversity of the installation site.

FIG. 3 closely exhibits the in-place status of the edges of an AESPS 10000, where the fronded eco-mattress installation 10013 either links to or overlaps the boundary of single layer rock blankets 10012. The fronded design would be such that the export cable 10017 could be installed after the mattress installation 10013 was in place, and the cable 10017 would be able to rest between or within the fronds 10008. The fronded design would have fronds 10008 of sufficient lateral stiffness to hold the cable 10017 in place. The fronds 10008 would both divert localized current flow, decreasing the load on the cable 10017, as well as provide lateral support to prevent or limit lateral movement of the cable 10017.

Another key benefit of the fronded eco-mattresses 10007 is that they are to be designed and manufactured in such a way that a vessel capable of deploying the rock blanket 10012 could also deploy the fronded mattress units 10007. Even, if this dual use is not possible in a given installation and a second vessel is needed, the full scour projection system 10000 could be deployed in advance of the foundation installation with no follow up deployments required. Once installed, the scour projection system 10000 would therefore be removed from the monopile installation project's critical path timeline.

The eco-mattresses 10007 may comprise concrete that has been developed to be beneficial to marine life. In particular, a chemical composition of the cement and resulting concrete may use additives to improve the pH of the concrete and provide suitable substrates for sea life 10006, in particular such as for marine mollusks to adhere to. In addition, the individual concrete elements 10007 may be designed with surface features to maximize marine life use and habitat.

Figure 4:
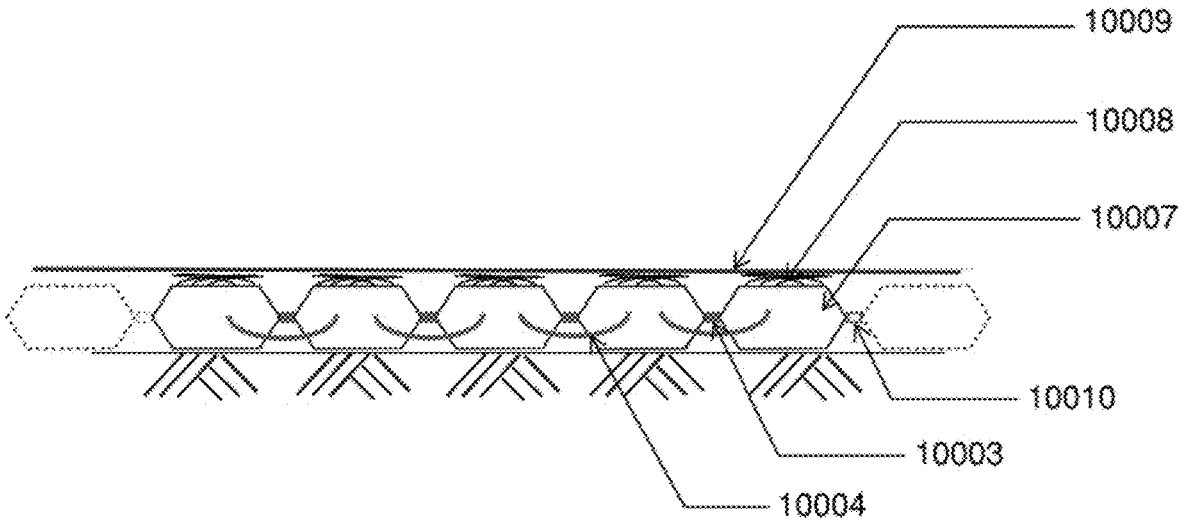
FIG. 4 shows a side elevation cross-sectional view of the simplified depiction of the exemplary embodiment of the system in FIG. 1, with a fronded eco-concrete mattress before releasing fronds, according to aspects of the invention.

Referring to FIG. 4, FIG. 4 shows a side elevation cross-sectional view of the simplified depiction of the exemplary embodiment of the system 10000 in FIG. 1, with a fronded eco-concrete mattress 10007 before releasing fronds 10008, according to aspects of the invention. Also depicted in FIG. 4 are concrete segment joints 10003 that interconnect concrete segments of the mattress 10007 and preferably permit flexibility of the fronded mattress 10007. The mattress unit 10007 also is depicted as including an interconnection device 10004, such as a metal loop or hook, to interconnect and adjoin one mattress unit 10007 with an adjacent adjoining fronded mattress unit 10007, to be adjoined to another fronded mattress unit 10007 by a connection joint 10010. Prior to and during installation of the mattress unit 10007, the fronds 10008 preferably are covered by a fronds cover 10009, which preferably is a fast-release cover that may be removed easily and quickly once the system 10000 is installed and the monopile foundation 10011 is installed and ready.

Figure 5:
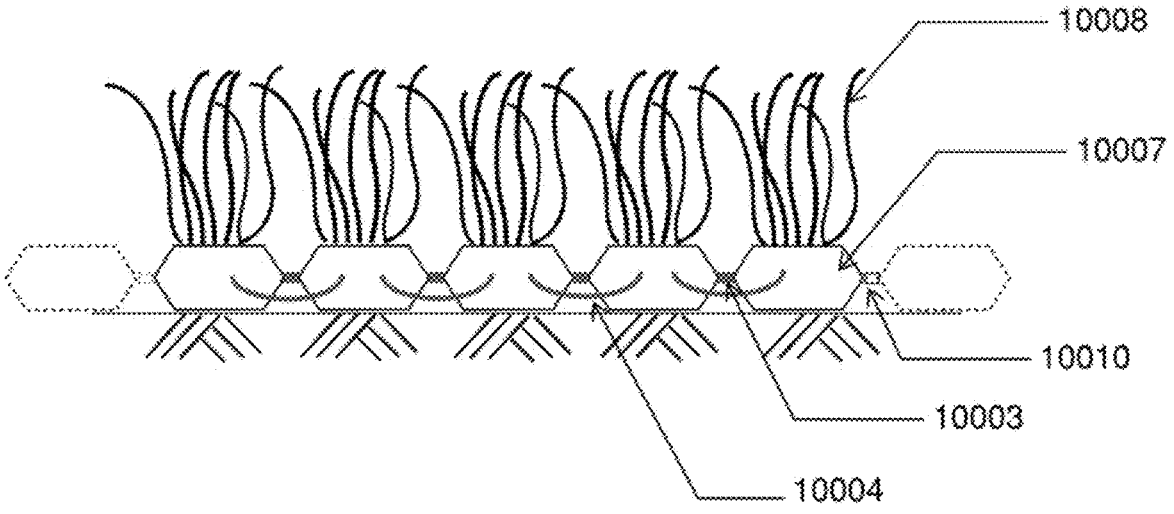
FIG. 5 shows a side elevation cross-sectional view of the simplified depiction of the exemplary embodiment of the system in FIG. 4, with the fronded eco-concrete mattress after releasing fronds, according to aspects of the invention.

Referring to FIG. 5, FIG. 5 shows a side elevation cross-sectional view of the simplified depiction of the exemplary embodiment of the system in FIG. 4, with the fronded eco-concrete mattress 10007 after releasing fronds 10008, and after removing any fronds cover 10009, according to aspects of the invention. Also depicted in FIG. 5 is an adjacent adjoining fronded mattress unit 10007, adjoined to another fronded mattress unit 10007 by a connection joint 10010, preferably fabricated and made of eco-friendly materials.

FIG. 4 and FIG. 5 present, respectively, the in-transit and in-place status of the fronded eco-concrete mattress 10007. During the transportation, the self-buoyant frond lines 10008 may be folded airtightly and may be covered by one or more top sheets 10009 to prevent potential damage. Once a frond mattress 10007 is lowered and placed on the seabed, a diver or ROV can remove the cover sheet 10009, such as by unlocking any locks along the sides, and can retrieve the cover sheet 10009 to the vessel. The fronded lines 10008, made of buoyant polyester, will then float and create a condense flow-barrier around the monopile foundation 10011, attracting and supporting marine habitats and marine life 10006 within the area.

Figure 6:
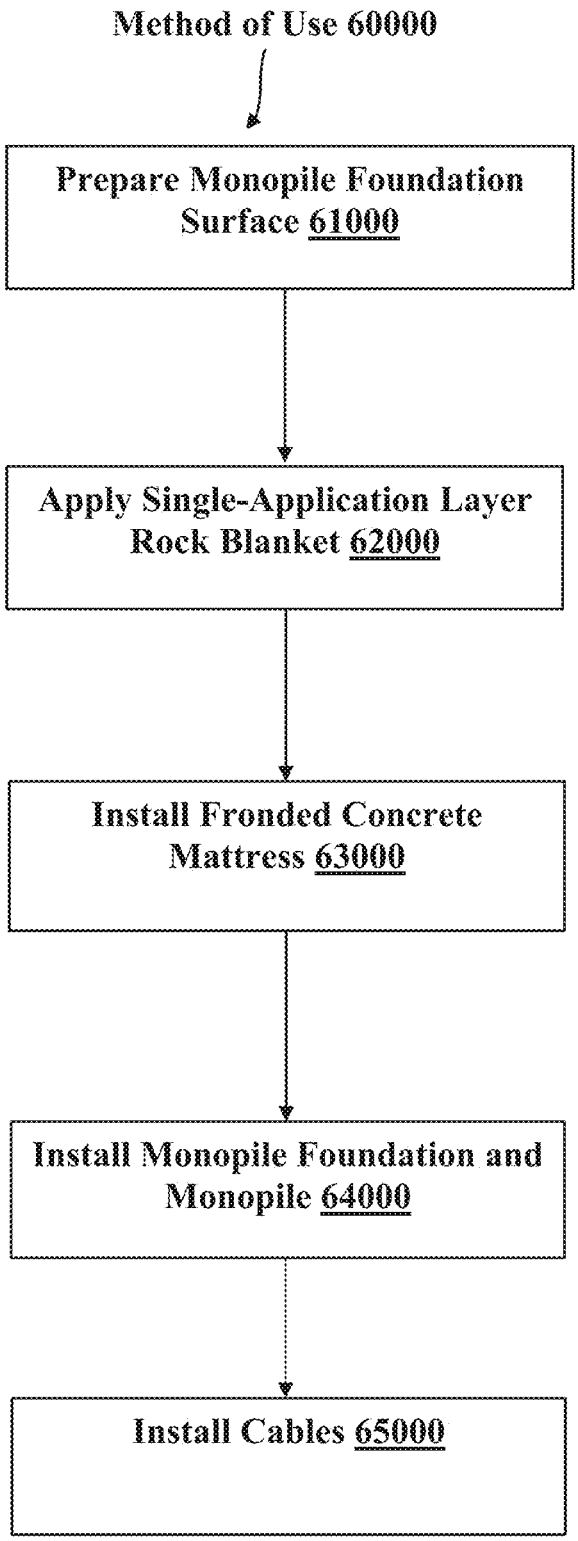
FIG. 6 shows a block diagram of an exemplary embodiment of a method for use in protecting an undersea monument foundation against undersea scour, for use within a system and/or apparatus in accordance with exemplary embodiments of the present invention, according to aspects of the invention.

Referring to FIG. 6, FIG. 6 shows a block diagram of an exemplary embodiment of a method 60000 for use in protecting an undersea monument foundation 10011 against undersea scour, for use within a system 10000 and/or apparatus in accordance with exemplary embodiments of the present invention, according to aspects of the invention. The method 60000 may begin with an optional step 61000 to prepare an undersea ground surface at and around an intended site of a monopile foundation 10011, such as clearing and/or cleaning the surface to receive a foundation 10011. The method 60000 may proceed to step 62000 to apply a single-layer rock blanket 10012, such as a single-application layer rock blanket 10012, to cover and reinforce the surface. The method 60000 may proceed to step 63000 to install a fronded concrete mattress border 10013 on, at, and around a periphery of the rock blanket 10012, before installing the monopile foundation 10011 and an export cable 10017, such as from a wind-powered generator erected on the monopile foundation 10011. The method 60000 optionally may proceed to optional step 64000 to install the monopile foundation 10011 and corresponding monopile, followed by optional step 65000 to install any export cables 10017.

The foregoing description discloses exemplary embodiments of the invention. While the invention herein disclosed has been described by means of specific embodiments and applications thereof, numerous modifications and variations could be made thereto by those skilled in the art without departing from the scope of the invention set forth in the claims. Modifications of the above disclosed apparatus and methods that fall within the scope of the claimed invention will be readily apparent to those of ordinary skill in the art. Accordingly, other embodiments may fall within the spirit and scope of the claimed invention, as defined by the claims that follow hereafter.

In the description above, numerous specific details are set forth in order to provide a more thorough understanding of embodiments of the invention. It will be apparent, however, to an artisan of ordinary skill that the invention may be practiced without incorporating all aspects of the specific details described herein. Not all possible embodiments of the invention are set forth verbatim herein. A multitude of combinations of aspects of the invention may be formed to create varying embodiments that fall within the scope of the claims hereafter. In addition, specific details well known to those of ordinary skill in the art have not been described in detail so as not to obscure the invention. Readers should note that although examples of the invention are set forth herein, the claims, and the full scope of any equivalents, are what define the metes and bounds of the invention protection. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. An apparatus assembly adapted for use in protecting an undersea monument foundation against undersea scour, the apparatus comprising:

a single-layer gravity-based protection of a central area centered around a center of the undersea monument foundation, and a fronded concrete mattress border covering and surrounding a periphery of the single-layer gravity-based protection.

2. The apparatus assembly of claim 1, the apparatus assembly further comprising:

an export cable extending from the undersea monument foundation, extending over the single-layer gravity-based protection, and extending over the fronded concrete mattress border, wherein the export cable rests among and between fronds extending from fronded concrete mattress border.

3. The apparatus assembly of claim 1, wherein the single-layer gravity-based protection comprises:

a rock blanket, wherein the rock blanket is adapted to be applied on an undersea ground surface, over and around the center of the undersea monument foundation.

4. The apparatus assembly of claim 1, wherein the fronded concrete mattress border comprises:

a plurality of fronded concrete mattresses, wherein the plurality of fronded concrete mattresses is adapted to be positioned around the periphery of the single-layer gravity-based protection to form a peripheral ring on, over, and around an edge of the single-layer gravity-based protection at a border of the single-layer gravity-based protection and a ground surface of the undersea ground.

5. A system adapted for use in protecting an undersea monument foundation against undersea scour, the system comprising:

an application of a single-layer gravity-based protection to a central area adapted to be centered around a center of the undersea monument foundation, and an installation of a fronded concrete mattress border covering and surrounding a periphery of the single-layer gravity-based protection;

wherein the application of the single-layer gravity-based protection is adapted to be applied to an undersea ground surface at an intended site of the undersea monument foundation, with the central area central to the intended site;

wherein the installation of the fronded concrete mattress border is adapted to be installed below and support any export cable exiting a monument positioned on a foundation installed at the intended site, and wherein a plurality of fronds of the fronded concrete mattress is adapted to engage and shelter the export cable supported on the installation.

6. The system of claim 5, the system further comprising:

the export cable extending from the undersea monument foundation, extending over the single-layer gravity-based protection, and extending over the fronded concrete mattress border, wherein the export cable rests among and between fronds extending from fronded concrete mattress border.

7. The system of claim 5, wherein the single-layer gravity-based protection comprises:

a rock blanket, wherein the rock blanket is adapted to be applied on an undersea ground surface, over and around the center of the undersea monument foundation.

8. The system of claim 5, wherein the fronded concrete mattress border comprises:

a plurality of fronded concrete mattresses, wherein the plurality of fronded concrete mattresses is adapted to be positioned around the periphery of the single-layer gravity-based protection to form a peripheral ring on, over, and around an edge of the single-layer gravity-based protection at a border of the single-layer gravity-based protection and a ground surface of the undersea ground.

9. A method adapted for use in protecting an undersea monument foundation against undersea scour, the method comprising:

preparing an undersea ground surface at an intended site of an undersea monument foundation;

applying a single-layer gravity-based protection to a central area of the undersea ground surface at the intended site of the undersea monument foundation; and installing a fronded concrete mattress border covering and surrounding a periphery of the single-layer gravity-based protection;

wherein installing the fronded concrete mattress border is adapted to position the fronded concrete mattress border below and to support any export cable exiting a monument positioned on a foundation installed at the intended site, and wherein a plurality of fronds of the fronded concrete mattress is adapted to engage and shelter the export cable supported on the installation.

10. The method of claim 9, the method further comprising:

Installing the export cable extending from the undersea monument foundation, extending over the single-layer gravity-based protection, and extending over the fronded concrete mattress border, wherein the export cable rests among and between fronds extending from fronded concrete mattress border.

11. The method of claim 9, wherein the single-layer gravity-based protection comprises:

a rock blanket, wherein the rock blanket is adapted to be applied on an undersea ground surface, over and around the center of the undersea monument foundation.

12. The method of claim 9, wherein the fronded concrete mattress border comprises:

a plurality of fronded concrete mattresses, wherein the plurality of fronded concrete mattresses is adapted to be positioned around the periphery of the single-layer gravity-based protection to form a peripheral ring on, over, and around an edge of the single-layer gravity-based protection at a border of the single-layer gravity-based protection and a ground surface of the undersea ground.

* * * * *